United States Patent [19]

Kulesza et al.

[11] Patent Number: 4,504,239

[45] Date of Patent: Mar. 12, 1985

[54] TOY LAND VEHICLE AND AIRCRAFT COMBINATION

[75] Inventors: Ralph J. Kulesza, Chicago; Harry Disko, South Barrington; Dennis R. Gibbons, Hometown, all of Ill.

[73] Assignee: Marvin Glass & Associates, Chicago, Ill.

[21] Appl. No.: 462,318

[22] Filed: Jan. 31, 1983

[51] Int. Cl.[3] ..... A63H 17/00; A63H 29/02

[52] U.S. Cl. ..... 446/95; 446/232; 446/435; 446/462

[58] Field of Search ..... 446/69, 94, 95, 93, 446/232, 230, 237, 431, 462, 470, 471, 457, 435, 465, 454

[56] References Cited

U.S. PATENT DOCUMENTS

| | | | |
|---|---|---|---|
| 2,755,596 | 7/1956 | Weil | 46/202 X |
| 2,791,807 | 5/1957 | Dasher | 46/202 X |
| 3,659,378 | 5/1972 | Tong | 46/251 |
| 3,826,039 | 7/1974 | Disko et al. | 46/209 X |
| 4,073,086 | 2/1978 | Ogawa | 446/232 X |

FOREIGN PATENT DOCUMENTS

| | | | |
|---|---|---|---|
| 959170 | 2/1957 | Fed. Rep. of Germany | 46/202 |

*Primary Examiner*—Mickey Yu

*Attorney, Agent, or Firm*—John S. Pacocha

[57] ABSTRACT

A self-propelled military type land vehicle with a power take-off friction coupling in the form of a rotating cannon fits into and is retained in a helicopter shell with the power coupling driving the helicopter rotor. A releasable latch carried by the helicopter retains the vehicle within the helicopter shell and in driving engagement during simulated flight. The helicopter has a hand grippable depending tail support with a trigger disposed near the support for effecting release of the land vehicle and disengagement of the power take-off coupling from the rotor without braking the rotor.

20 Claims, 9 Drawing Figures

TOY LAND VEHICLE AND AIRCRAFT COMBINATION

BACKGROUND OF THE INVENTION

1. Field of the Invention

This invention relates generally to combinable toy vehicles and more particularly to a self-propelled vehicle and an unpowered vehible combination.

2. Background Art

Combinable toy vehicles have long been popular toys. Employing a self-propelled vehicle to drive rotatable elements other than the wheels of the vehicle has also been done in the prior art. Examples of the use of the rotating wheel drive of a land vehicle to also drive an element associated with the vehicle may be found in U.S. Pat. Nos. 3,065,569 and 4,083,143. Inserting and retaining a self-propelled car within an unpowered land carrier vehicle is shown in U.S. Pat. No. 4,192,093. There remains, however, a need for a variety of such combinable drive toys, particularly ones which permit the use of the vehicles separately and in combination to simulate various military and adventure scenarios.

SUMMARY OF THE INVENTION

The present invention is concerned with providing a combinable self-propelled land vehicle and aircraft to provide a toy in which the combinable elements may be played with separately, as well as in combination, on a surface or in simulated flight. These and other objects and advantages of the invention are achieved by providing a self-propelled wheeled land vehicle including a power take-off engagable with a rotating member on an aircraft having a shell with an opening. The land vehicle is insertable into the opening and is releasably retained within the aircraft with the driven ground wheels of the vehicle supporting the aircraft for propulsion along a surface. Inserting the land vehicle into the aircraft shell also effects driving engagement between the power take-off and the aircraft rotating member that is maintained even if the combination is lifted off of the surface. The vehicles are retained in combination by a biased latch which may be released through a trigger to drop the land vehicle while the aircraft is hand-held above the surface and to automatically disengage the power take-off permitting continued inertial rotation of the element.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
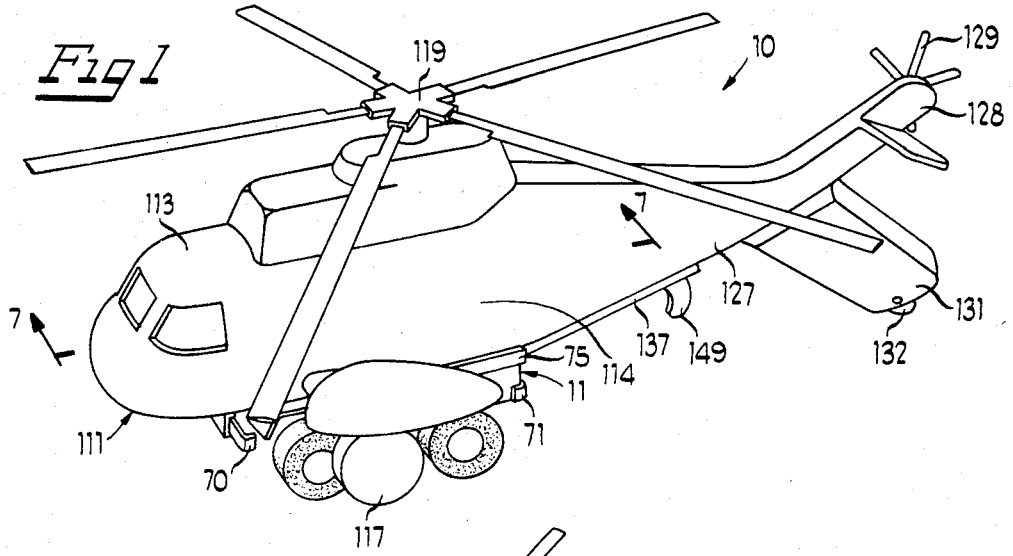
FIG. 1 is a perspective view of the combined toy land vehicle and aircraft of the present invention.
Figure 2:
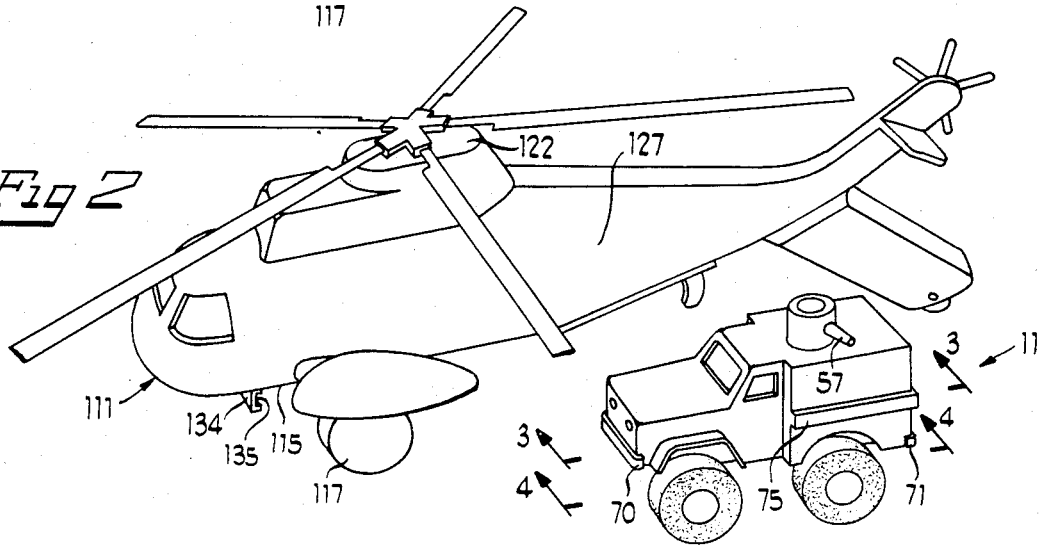
FIG. 2 is a perspective view showing the land vehicle and aircraft separated.

Referring now to the drawings in which like parts are designated by like reference numerals throughout the several views, there is shown in FIG. 1 a combination 10 of a military type land vehicle 11 and a helicopter 111 which may be separated as depicted in FIG. 2 and played with separately.

Vehicle 11 has a chassis 13 in which a front axle 15 and a rear axle 17 are journaled for rotation. The ends of the axles project beyond the sides of the chassis. Fitted onto each projecting end of each of the axles, for rotation with the axle, by means of a splined axle end, pressed fit, or other conventional method, is a hub 19. A ground engaging wheel 20 is similarly secured to the hub 19 for rotation with the hub and axle. Each of the wheels 20 is substantially equally spaced from the respective side of the chassis 13. In the embodiment shown, the front axle 15 and its hubs 19 and wheels 20 are free wheeling although they could be driven in a manner similar to the rear axle 17 and its hub and wheel assemblies.

The chassis 13 carries a DC electric motor 22 and a power source 23 such as an AA penlight battery. Metal spring clips 25 and 26 affixed to the chassis releasably retain the battery in electrical contact. An on/off switch includes a spring contact 28 connected to the clip 26 at one end and urged into electrical contact with the motor 22 at the other end. An on/off button 30 projects downwardly and is exposed through an aperture in the bottom of the chassis 13 for manual actuation of the switch. The remainder of the conventional electrical connections between the motor 22 and the battery 23 are not shown.

Motor 22 has an output shaft 32 with a pinion 33 fixed for rotation by the motor. A shaft 35 is journaled for rotation on the chassis 13 parallel to the motor shaft 32. Spur gear 36 and coaxial worm 37 are secured to the shaft 35 for rotation with the shaft and may be formed as an integral piece. The motor pinion 33 is in driving engagement with the spur 36 causing rotation of the worm 37. A wheel drive worm gear 39 is mounted on the rear axle 17 for rotation with the axle. Worm 37 is in driving engagement with the worm gear 39 to propel the vehicle 11 through the wheels 20 on the rear axle 17.

Figure 8:
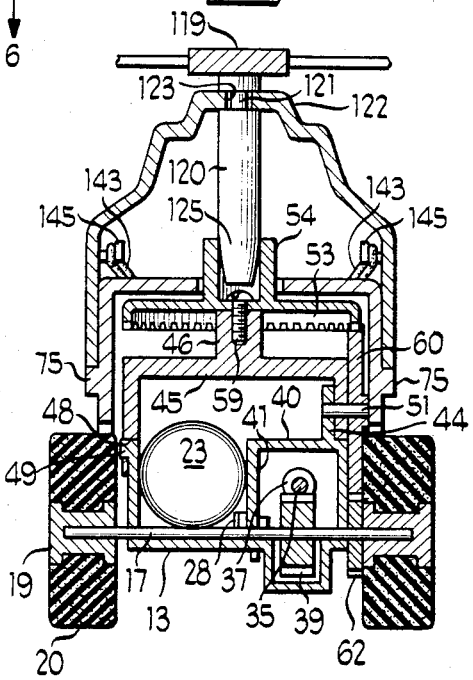
FIG. 8 is a sectional view taken substantially along line 8—8 of FIG. 7.
Figure 6:
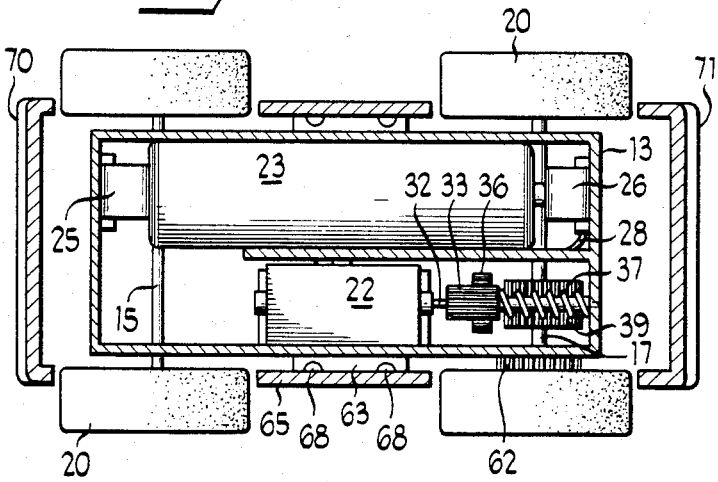
FIG. 6 is a sectional view taken substantially along line 6—6 of FIG. 4 with some parts omitted.

A "step" shaped cover 40 fits over the power transmission comprising motor output shaft 32, pinion 33, shaft 35, spur 36, worm 37, and worm gear 39. In addition, the lower, essentially vertical, riser portion 41 of the cover fits between the battery and the motor as is best shown in FIG. 6. An aperture in the top of the cover fits over the motor to secure the motor 22 and shaft 35. For this purpose, the cover 40 is fastened to the chassis 13 at the front and back by detents 42 that snap over chassis projections 43. An upper riser portion 44 extends rearwardly and upwardly on the cover 40 as is best shown in FIG. 8.

A transverse bridge member 45 with a substantially centrally disposed upstanding post 46 is mounted atop and across the chassis 13. One leg of the bridge is fastened to the chassis by a detent 48 that snaps over a chassis projection 49 like that used for securing the cover 40 to the chassis and the other leg of the bridge is pinned to the riser 44 by a stub shaft 51 that projects outwardly through the riser and bridge leg as shown in FIG. 8. Mounted on the post 46 is an integrally formed crown gear 53 and upwardly projecting power take-off driver 54 that has an open top cylindrical sleeve socket 55. The upper outer part of the power driver 54 may be formed with, or have attached, a projection such as the simulated cannon 57 that is in keeping with the theme or design of the vehicle 11. A screw 59 is inserted through the open top socket 55 to attach the integral crown and power driver to the post 46 for rotation on the post.

The teeth of the crown gear 53 are downwardly disposed and in driven engagement with an intermediate gear 60 mounted for rotation on the projecting end of the stub shaft 51. The intermediate gear 60 is in driven engagement with a power take-off spur gear 62 that is affixed to the rear axle 17 adjacent one end for rotation with the rear axle. The gear 62 is disposed in the space between the outside of the chassis 13 and the respective hub 19 and wheel 20 affixed to the end of the rear axle 17.

Figure 5:
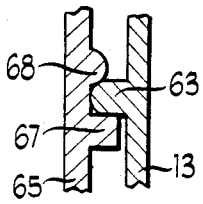
FIG. 5 is an enlarged fragmentary sectional view taken substantially along line 5—5 of FIG. 4.
Figure 9:
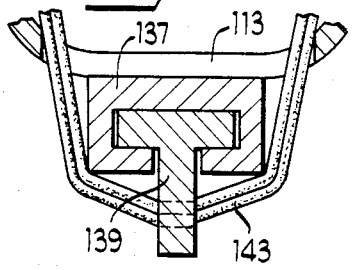
FIG. 9 is an enlarged fragmentary sectional view taken substantially along line 9—9 of FIG. 7.
Figure 4:
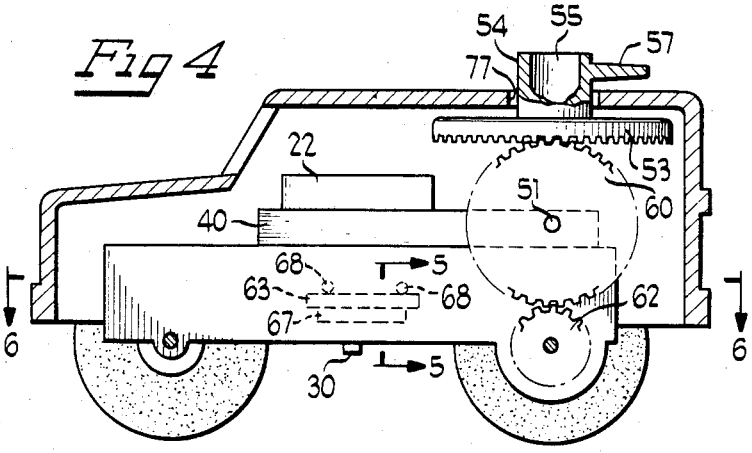
FIG. 4 is an enlarged sectional view taken substantially along line 4—4 of FIG. 2.

Protruding out from each side of the chassis 13, at about the center of the length of the chassis, is a ledge 63. The vehicle 11 is provided with a body 65 of a suitable appearing design. Each side of the body 65, at approximately the midpoint of the length, is provided with an inwardly projecting lower rib 67 and a pair of spaced apart nibs 68 that are also spaced from the rib 67 a distance about equal to the thickness of the ledge 63 as is best shown in FIG. 5. The body 65 is sufficiently resilient so that it may be attached to the chassis 13 by exerting a downward force that snaps rib 67 over the ledge 63 into retained engagement between the nibs 68 and the rib 67. A similar upward force will release the body 65 from the chassis 13. Thus the chassis, drive wheel, motor, and power transmission assembly may be employed for a variety of different body styles.

The body 65 is provided with a front boss 70 that is incorporated into the selected body style as the front bumper. The vehicle may also be provided with a rear bumper 71. A rear boss 73 spaced above the rear bumper 71 projects outwardly from the back end of the vehicle body 65. In this embodiment the rear boss 73 is part of a continuous rim that includes the side ledges 75 that extend outwardly from the sides of the vehicle body 65 simulating the rearward part of the vehicle 11. The ledges 75 and rear boss 73 are all spaced above the wheels 20 and no part of the vehicle body 65 above the rear boss 73 and ledges 75 projects outwardly any further than the rear boss and ledges. The roof portion of the vehicle body 65 is provided with an aperture 77 through which the power driver 54 with the cannon 57 extends for rotation.

The helicopter 111 has a fuselage or shell 113 with a central hollow cargo portion 114 large enough to receive all but the lowermost part of the vehicle 11 through an opening 115 in the bottom of the shell. The sides of the opening 115 in the helicopter fuselage have edges that abut the top of the ledges 75 on the sides of the vehicle to limit how much of the vehicle body can be inserted into the fuselage shell.

The shell 113 is provided with a stationary landing wheel or strut 117 extending outwardly and downwardly from each side of the shell. A substantially horizontal, multivaned rotor 119 is secured to an essentially vertical shaft 120 with a necked-down portion 121 that projects through the shell top 122 and is journaled for rotation about the axis of the shaft through an aperture 123. The body or trunk of the shaft 120 is cylindrical with a diameter slightly greater than that of the socket 55 with a downwardly converging taper toward the free end or tip 125. Aft of the cargo portion 114 is a tail section 127 with upwardly extending part 128 that supports an unpowered tail rotor 129 which may be stationary or free wheeling. Depending downwardly and outwardly away from the tail section is a support member 131 that is of a size conveniently grippable by a child's hand. The bottom of the member 131 helps support the helicopter on a surface and may be provided with a skid or wheel 132.

Depending downwardly from the front end of the opening 115 is a lip 134 in which is formed an inwardly facing detent 135. When the vehicle 11 is properly positioned within the helicopter 111, the front boss or bumper 70 of the vehicle will fit into the detent 135. A channel 137 is disposed along the bottom of the tail section 127 between the rear of the opening 115 and the support member 131. A "T" shaped beam 139 is mounted in the channel for reciprocal fore and aft movement. The horizontal top of the forward end 141 of the beam 139 fits under the rear boss 73 on the vehicle body 65 when the vehicle is properly positioned within the opening 115 in the helicopter shell. With the forward end 141 of the beam engaging the rear boss 73 and the front boss 70 fitting into the detent 135, the vehicle 11 is retained within the helicopter 111 so that if the helicopter is picked up the vehicle will also be picked up from the surface on which the child is playing.

Figure 7:
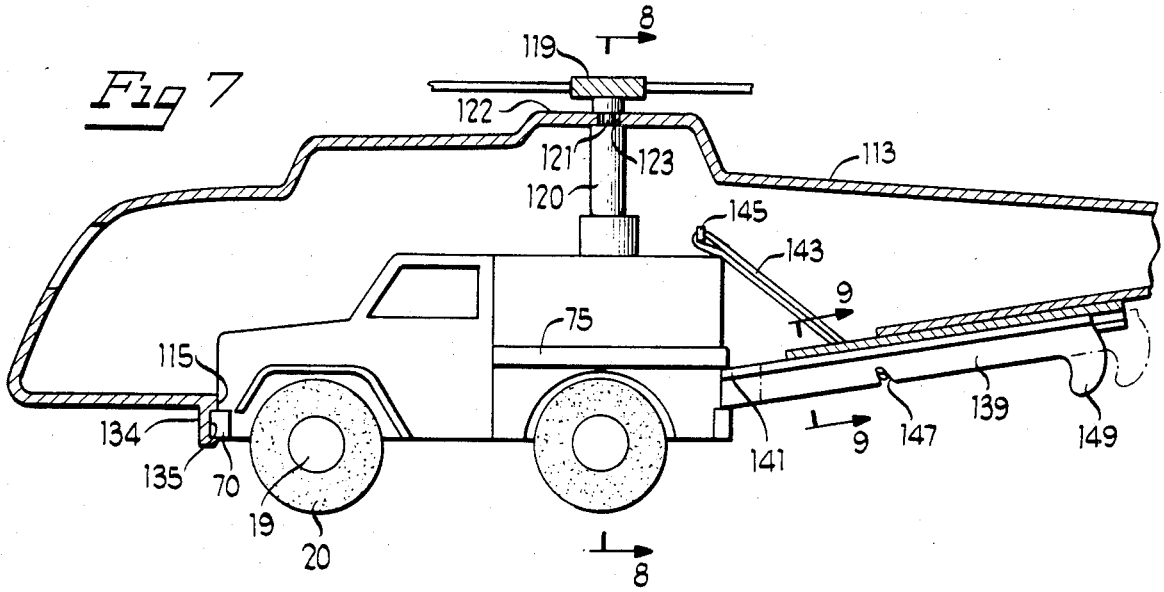
FIG. 7 is an enlarged partial sectional view taken substantially along line 7—7 of FIG. 1.
Figure 3:
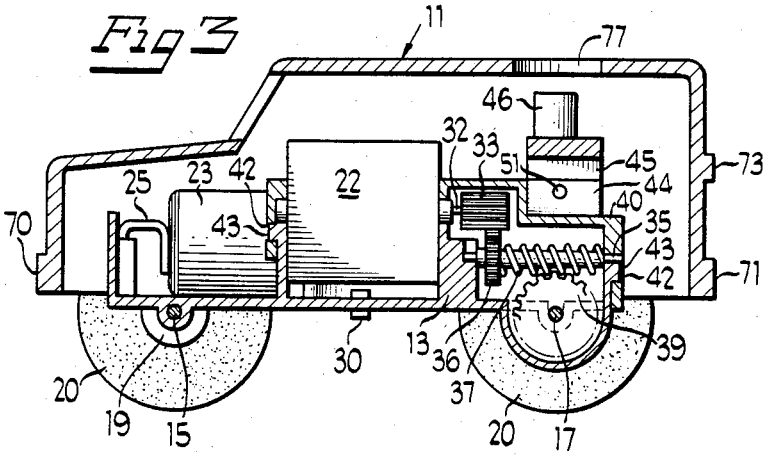
FIG. 3 is an enlarged sectional view taken substantially along line 3—3 of FIG. 2 with a part of the power take-off omitted.

A rubberband 143 with each of its ends looped over a respective peg 145 on the inside of the fuselage 113 passes through a slot 147 in the beam to bias the beam toward the fore end of the helicopter and urge the forward end 141 of the beam into engagement with the vehicle rear boss 73. The rearward end of the beam 139 is formed with a downwardly projecting hook or trigger 149 that is disposed in proximity to the hand grippable support member 131 so that the trigger is engagable by the index finger of a hand gripping the support member. To permit the insertion of the vehicle 11 into the shell 113, the trigger and beam may be pulled toward the hand grip 131 out of engagement with the boss 73 as in the phantom line showing in FIG. 7. Upon release of the trigger 149, the rubberband biasing force will return the forward end 141 to its vehicle engaging and retaining position.

When the vehicle 11 is inserted into the opening 115, the open socket 55 will be disposed substantially under the downwardly depending shaft 120. The tapered tip 125 will fit easily into the open socket 55 and the taper will help to properly position the vehicle within the opening. In addition, the taper 125 will wedge into the open socket 55 to frictionally engage the power driver 54 and the shaft 120 so that the rotor 119 will be driven by the motor 22 through the shaft 120, power driver 54, crown gear 53, intermediate gear 60, spur gear 62, axle 17, worm gear 39, worm 37, spur 36, and pinion 33 on the motor output shaft 32.

The child may selectively play with the vehicle 11 with its simulated rotating cannon 57 by itself and use the helicopter 111 by itself in a variety of play situations including simulated flight by grasping the helicopter and moving it about. Alternatively, the child may employ the combination 10 to simulate an operation wherein the helicopter 111 hovers over and descends upon the vehicle 11 to pick it up and fly away with it. In such an operation, the child could grasp the helicopter by the downwardly depending hand grippable portion 131 and depress the trigger to move the beam 139 back away from the opening 115 upon lowering atop the vehicle 11 and then after properly positioning the helicopter and abutting the vehicle ledges 75, release the trigger and take off with the vehicle retained substantially within the cargo portion 114 of the helicopter. During such a pick-up operation, the vehicle 11 may be stationary with the motor 22 turned off or have the motor turned on and be moving along a surface. The movement of the vehicle 11 would make the pick-up more challenging but would, upon accomplishing the proper position of the helicopter 111, immediately result in having the helicopter rotor 119 begin turning. A landing or drop-off operation may be similarly enacted by the child. Having the vehicle motor turned on during the drop-off provides the additional exciting play action of the vehicle dropping out of the cargo portion of the helicopter and speeding off while the helicopter is still being supported in a hover position above the surface. In such an operation the child gripping the tail member 131 would pull the trigger 149 to move the beam end 141 out of engagement with the rear boss 73, and since the center of gravity of the vehicle is to the rear of the center line toward the rear axle 17, the back end of the vehicle should drop downwardly pivotting the front boss 70 out of engagement with the detent 135. Upon hitting the surface the vehicle 11 should then speed off along the surface while the helicopter 111 may be manipulated as desired by the child. After the vehicle is dropped from the helicopter, the rotor should continue to free wheel of its own inertia for a period of time since the uncoupling of the tapered end 125 of the shaft 120 from the cylindrical socket 55 should not of itself brake the rotation.

While a particular embodiment of the present invention has been shown and described, it will be apparent to those skilled in the art that various changes and modifications may be made without departing from the true spirit and scope of the present invention. It is intended in the appended claims to cover all such changes and modifications.

What is claimed as new and desired to be secured by Letters Patent is:

1. Combinable toy vehicles comprising:
a first self-propelled vehicle having a body;
rotatable ground wheels supporting the body for movement along a surface;
motor means carried by the first vehicle and drivingly connected to at least one of the wheels;
a second vehicle having a shell with an opening;
a rotatable member mounted on the second vehicle and exposed outside the shell;
a portion of the body being insertable into the shell through the opening with the wheels exposed;
power transmission means carried by the first vehicle;
the power transmission means being driven by the motor means and having a power driver;
the rotatable member being couplable with the power driver upon insertion of the body into the shell;
latch means releasably retaining the body with the portion within the shell;
the second vehicle being supported on and propelled along a surface by the ground wheels with the rotatable member driven by the motor means; and
the second vehicle retaining and supporting the first vehicle with the rotatable member being driven by the motor means when the combined vehicles are lifted off the surface.

2. The combinable toy vehicles of claim 1 including trigger means carried by one of the vehicles for releasing the latching means and uncoupling the power driver and rotatable member.

3. The combinable toy vehicles of claim 2 in which:
the second vehicle is an aircraft;
the shell has a tail section disposed aft of the opening;
fore ground support means extend downwardly from the shell adjacent the opening;
aft ground support means extend downwardly from the shell adjacent the tail section; and
the fore ground support means are inoperative when the first vehicle is inserted into the shell and is supporting the aircraft.

4. The combinable toy vehicles of claim 1 in which:
the second vehicle is a helicopter;
the rotatable member is a substantially horizontal rotor turning about a substantially vertical shaft;
the power driver includes an essentially vertically disposed socket that is open at the top; and
the lower portion of the shaft fits into the socket to couple the rotor and the power driver into driving engagement.

5. The combinable toy vehicles of claim 4 in which the lower portion of the shaft has a downwardly converging taper that fits into and frictionally couples with the socket.

6. The combinable toy vehicles of claim 4 in which:
the first vehicle has a body with a roof section; and
the open top of the socket protrudes through the roof section.

7. The combinable toy vehicles of claim 4 in which:
the shell has a tail section disposed aft of the opening;
fore ground support means extend downwardly from the shell adjacent the opening;
aft ground support means extend downwardly from the shell adjacent the opening; and
the fore ground support means are inoperative when the first vehicle is inserted into the shell and is supporting the helicopter.

8. Combinable toy vehicles comprising:
a first self-propelled vehicle having a body;
rotatable ground wheels supporting the body for movement along a surface;
motor means carried by the first vehicle and drivingly connected to at least one of the wheels;
a second vehicle having a shell with an opening;
a rotatable member mounted on the second vehicle and exposed outside the shell;
a portion of the body being insertable into the shell through the opening with the wheels exposed;
power transmission means carried by the first vehicle;
the power transmission means being driven by the motor means and having a power driver;
the rotatable member being couplable with the power driver upon insertion of the body into the shell;
latch means releasably retaining the body with the portion within the shell;
the second vehicle being supported on and propelled along a surface by the ground wheels with the rotatable member driven by the motor means;
the first vehicle body having spaced sides;
a ledge extending outwardly from each of the sides;
the opening having sides with abutment surfaces;

the portion of the first vehicle insertable into the shell through the opening including part of the body; and the abutment surfaces of the sides of the opening contacting the ledges when the first vehicle is inserted into the opening to arrest further insertion of the body into the shell.

9. The combinable toy vehicles of claim 1 in which both the first vehicle and the opening have respective spaced front and rear ends and the latch means includes:

an inwardly facing front detent formed in the shell adjacent the front end of the opening; and a front boss projecting outwardly from the front end of the first vehicle that fits into the front detent when the first vehicle is inserted and properly positioned in the shell.

10. The combinable toy vehicles of claim 9 in which the latch means further includes:

a rear boss projecting outwardly from the rear end of the first vehicle; and a movable beam carried by the shell proximate the rear end of the opening is normally urged into engagement with the rear boss by biasing means when the body is properly positioned within the shell.

11. The combinable toy vehicles of claim 10 in which:

the beam is elongated and has a latching end and a trigger end;

the latching end is normally urged into engagement with the rear boss;

the shell has a support member spaced rearwardly of the rear end of the opening;

the trigger end is disposed adjacent the support member; and actuation of the trigger in opposition to the biasing means will move the latching end out of engagement with the rear boss to permit the force of gravity to effect the release of the first vehicle from the shell and to uncouple the power driver and rotatable member.

12. The combinable toy vehicles of claim 11 in which the elongated beam is carried for reciprocable movement by a channel in the shell.

13. The combinable toy vehicles of claim 10 in which:

the second vehicle is a helicopter having a tail section;

a support grippable by a child's hand extends downwardly from adjacent the tail section;

a trigger engagable by a child's finger is attached to the beam and disposed such that it may be engaged by the index finger of a hand gripping the support; and exertion of a force on the trigger in opposition to the biasing means disengages the beam from the rear boss and releases the first vehicle from the shell and uncouples the power driver and rotatable member when the combined vehicles are off the surface.

14. The combinable toy vehicles of claim 1 in which:

the body has a rotatable associated element; and the power driver is formed as part of the associated element.

15. A toy land vehicle and aircraft combination comprising:

rotatable wheels and a motor mounted on the land vehicle;

first power transmission means between the motor and one of the wheels for propelling the land vehicle on a surface;

the land vehicle having a front end and a back end;

a front projection adjacent the front end and a back projection adjacent the back end of the land vehicle;

the aircraft having a member rotatable around a shaft;

the shaft having a free end;

the land vehicle carrying a socket for receiving the free end in frictional drive engagement;

second power transmission means between the motor and the rotatable member;

the second power transmission including the shaft and socket;

the aircraft having a fuselage with an opening intermediate its fore and aft ends;

the land vehicle being insertable into the fuselage through the opening;

a detent adjacent the end of the opening nearest the fore end of the fuselage;

the front projection on the land vehicle being engagable with the detent upon insertion of the land vehicle into the fuselage through the opening;

releasable biased latch means carried by the aircraft engagable with the rear projection on the land vehicle and releasably retaining the land vehicle within the fuselage in combination with the detent and front projection; and the land vehicle supporting and propelling the aircraft on a surface while simultaneously driving the aircraft rotatable member.

16. The toy land vehicle and aircraft combination of claim 15 in which:

the shaft has a cylindrical trunk;

the free end of the shaft has a taper that converges to a tip diameter that is less than the diameter of the trunk; and the socket is a cylindrical sleeve having an inside diameter that is less than the dimeter of the trunk and greater than the tip diameter.

17. The toy land vehicle and aircraft combination of claim 15 in which:

the aircraft has an aft tail section including a grippable support section; and the latch means includes a trigger disposed in proximity to the support for releasing the latch means in opposition to the bias.

18. The toy land vehicle and aircraft combination of claim 15 in which:

the aircraft has an aft tail section including a grippable support section; and the support section has a surface contact element to support the aircraft for propulsion on a surface along with the land vehicle.

19. The toy land vehicle and aircraft combination of claim 18 in which the fuselage has downwardly depending struts that engage a surface for supporting the aircraft on the surface when the land vehicle is not inserted within the fuselage.

20. The toy land vehicle and aircraft combination of claim 19 in which:

the land vehicle has spaced sides;

each of the sides has an outwardly projecting rim; and the opening has edges which abut the rims to limit the insertion of the land vehicle into the fuselage and support the aircraft on the surface without the struts engaging the surface.

* * * * *